US005419668A

United States Patent [19]

Ballist

[11] Patent Number: 5,419,668

[45] Date of Patent: May 30, 1995

[54] ADJUSTABLE BINDER STOP

[75] Inventor: Thomas Ballist, Buffalo Grove, Ill.

[73] Assignee: General Binding Corporation, Northbrook, Ill.

[21] Appl. No.: 117,796

[22] Filed: Sep. 8, 1993

[51] Int. Cl.[6] ..... B42B 9/00

[52] U.S. Cl. ..... 412/40; 412/14

[58] Field of Search ..... 412/7, 14, 16, 40

[56] References Cited

U.S. PATENT DOCUMENTS

| | | | |
|---|---|---|---|
| 2,820,975 | 1/1958 | Ruck et al. | 412/40 |
| 2,945,246 | 7/1960 | Duncan et al. | 412/40 |
| 3,125,887 | 3/1964 | Bouvier et al. | 74/20 |
| 3,227,023 | 1/1966 | Bouvier | 83/549 |
| 3,967,336 | 7/1976 | Cutter | 412/40 X |
| 4,645,399 | 2/1987 | Scharer | 412/16 |
| 5,211,522 | 5/1993 | Ho | 412/40 X |

*Primary Examiner*—Tom Hughes

*Attorney, Agent, or Firm*—Hill, Steadman & Simpson

[57] ABSTRACT

A binding machine for opening a multi-ring plastic binding element to install a stack of pages thereon, providing an improved adjustment mechanism to set the opening dimension of the rings corresponding to the stack of pages to be bound as well as the particular sized binding element to be used. The adjustment device provides a stop ring mounted coaxially around a rocker shaft which upon rotation imparts sliding movement to longitudinally arranged fingers which engage with and open the binder element rings, the stop ring rotationally adjustable with respect to the rocker shaft and arranged to interfere with a stationary stop of the apparatus upon preselected rotation of the rocker shaft.

10 Claims, 2 Drawing Sheets

ADJUSTABLE BINDER STOP

BACKGROUND OF THE INVENTION

The present invention relates to improvements in book binding machines and in particular to book bindings incorporating flexible multi-ring binding elements. The invention provides an improved adjustment feature for regulating the opening distance of a plurality of rings of multi-ring elements for binding a stack of sheets placed into the multi-ring element.

Such binding elements are known and described in U.S. Pat. No. 3,583,557. Machines for uncurling multiple rings of such a binder element are disclosed, for example, in U.S. Pat. Nos. 3,227,023, 3,125,887 and 4,645,399. In such machines, the binder element is placed against and in mesh with teeth of a comb portion. A handle is pulled by an operator which engages multiple hooks or "uncurling fingers" enmesh with the rings of the binder element to grasp the rings of the element and uncurl the rings to open them for placing a stack of sheets in position to receive the open ends of the multiple rings into corresponding holes previously punched in the stack of sheets.

According to U.S. Pat. No. 3,227,023, actuators for a slide bar which holds the uncurling fingers comes in pivotable contact with stop cams which are mounted on a shaft pivotable with respect to the machine housing and which by rotating can set a distance of uncurling.

SUMMARY OF THE INVENTION

The present invention provides an improved and simplified stop arrangement for the uncurling fingers of a binding machine.

According to the invention, an operating handle or lever is fixedly connected to a first rock shaft which is mounted for axial rotation within the machine. The first rock shaft is fixed to a plurality of actuating levers along its length, the actuating levers swinging with a rotation of the first rock shaft. The actuating levers are operatively connected to a plurality of corresponding linkage members which are pivotally mounted along a second rock shaft at a base end and pivotally mounted at a distal end to a slide assembly. The slide assembly mounts a plurality of uncurling fingers or hooks which are arranged within slots arranged corresponding to the spacing between teeth of a comb which holds a spine of the binding element in position during uncurling of the rings. Rocking of the handle therefor rotates the first rock shaft, swings the actuating levers, pivots the binder linkages about the second rock shaft which slides the hooks or fingers to open or uncurl the binding element rings to a varying extent depending on the pivoting angle of the handle by the operator.

To adjust the maximum extent of pivoting of the first rock shaft, and thus the degree of opening of the binder rings, a stop such as an internal rib is located within the machine, stationary with respect to the handle. A cam or stop ring is mounted axially on the first rock shaft, the cam having a radially extending abutting surface which is arranged to impact the stop upon rotation of the handle a prescribed angle. The rotary position of the cam can be adjusted for a greater or lesser angle of pivoting of the handle before the abutting surface strikes the stop.

To adjust the position of the cam, the cam is provided with a plurality of first gear teeth for meshing with a plurality of second gear teeth fixed to a cap which is fixed to the first rock shaft adjacent the lever. A spring is arranged axially fixed at one end with respect to the first rock shaft and which biases the cam such that the first gear teeth are enmesh with the second gear teeth and said cam rotates with said first rock shaft. To change the position of the cam with respect to the rock shaft, the cam is moved axially on the rock shaft against the bias of the spring to release the mating gear teeth from being enmesh wherein the cam can be rotated freely for adjustment with respect to the first rock shaft. The cam extends outside of the casing in an operator grippable adjustment ring having a setting marking thereon for exact rotary positioning of the cam vis-a-vis the cap, the cap having incremental markings around a partial circumference for setting the opening extent of the binder rings corresponding to the size of the binder element and the thickness of the stack of sheets to be held.

The invention provides a simple, economically manufactured, and rugged assembly for quickly setting and changing the opening extent of binder elements in a binding machine.

DETAILED DESCRIPTION OF THE PREFERRED EMBODIMENTS

Figure 1:
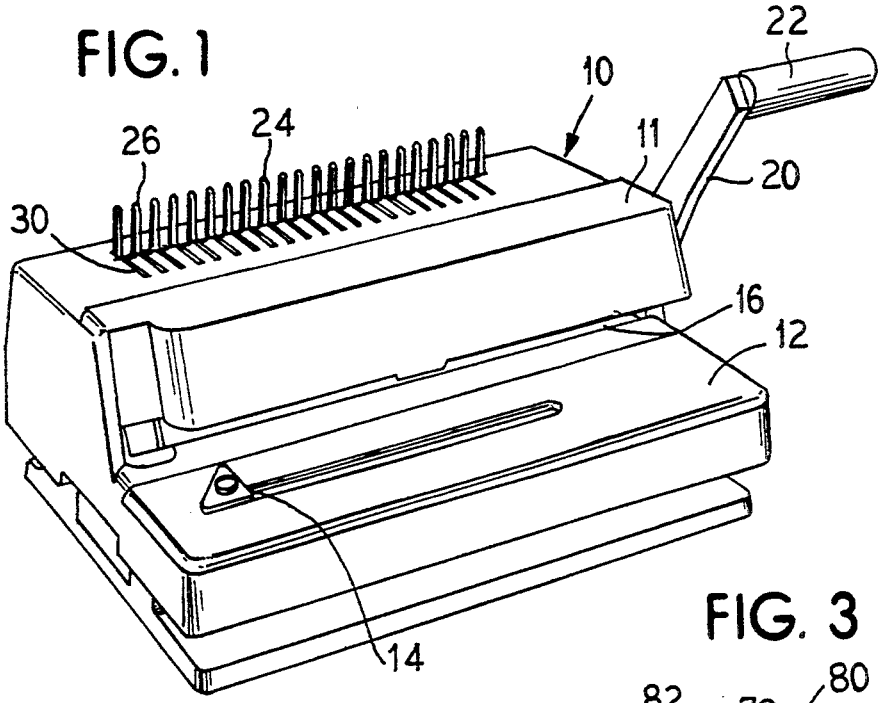
FIG. 1 is a perspective view of a book binding apparatus of the present invention.

FIG. 1 illustrates a book binding machine 10 having a cover 11 and a paper receiving platform 12 with a lateral guide 14 for accommodating varying page sizes. A recess 16 is provided to receive a stack of pages to be hole punched. Within the recess 16 is arranged a hole punching mechanism such as disclosed in U.S. Pat. No. 4,645,399 which is herein incorporated by reference. A lever 20 having a handle 22 is provided which both activates the hole punching mechanism (not shown) as well as activates a ring opening mechanism for page loading, as will be described hereinafter. On a top side of the apparatus 10 is arranged a comb structure 24 which receives a ring binding element enmesh therewith. Allocated between each tine 26 of the comb structure 24 is a slot 30 of a plurality of slots extending from the comb structure 24 toward a front side of the apparatus 10.

Figure 2:
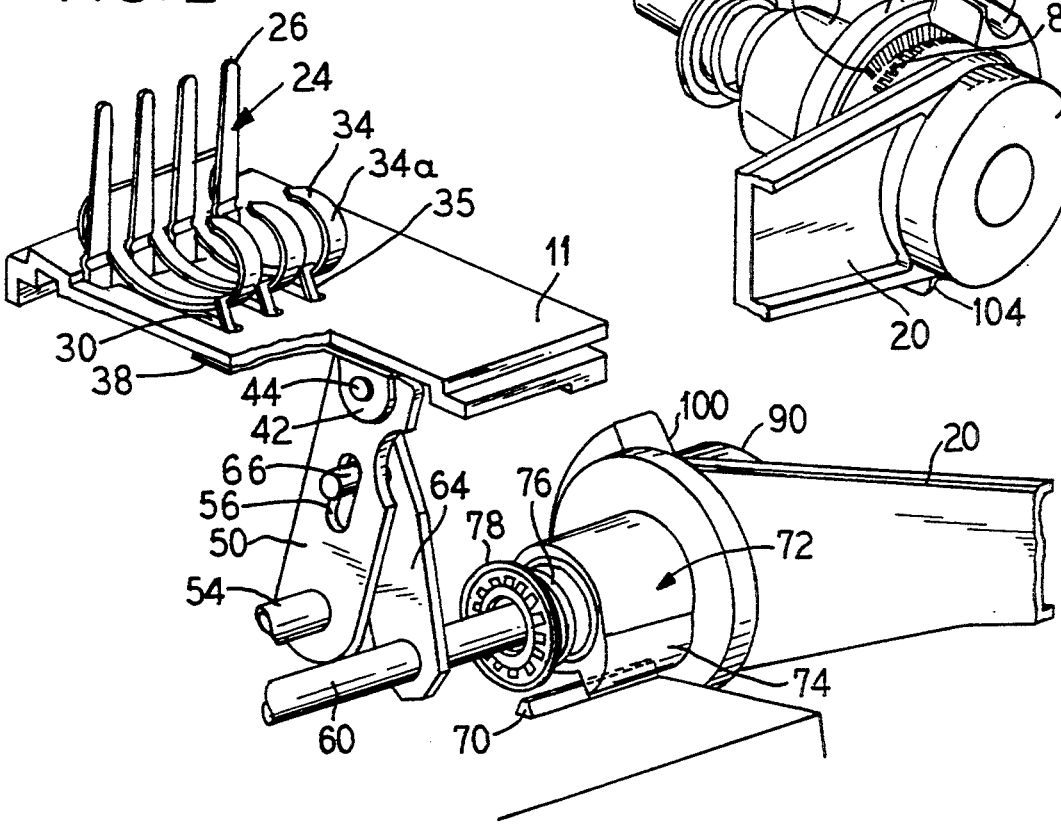
FIG. 2 is a partial perspective view of a ring opening mechanism of the apparatus of FIG. 1 with the cover removed for clarity.
Figure 5:
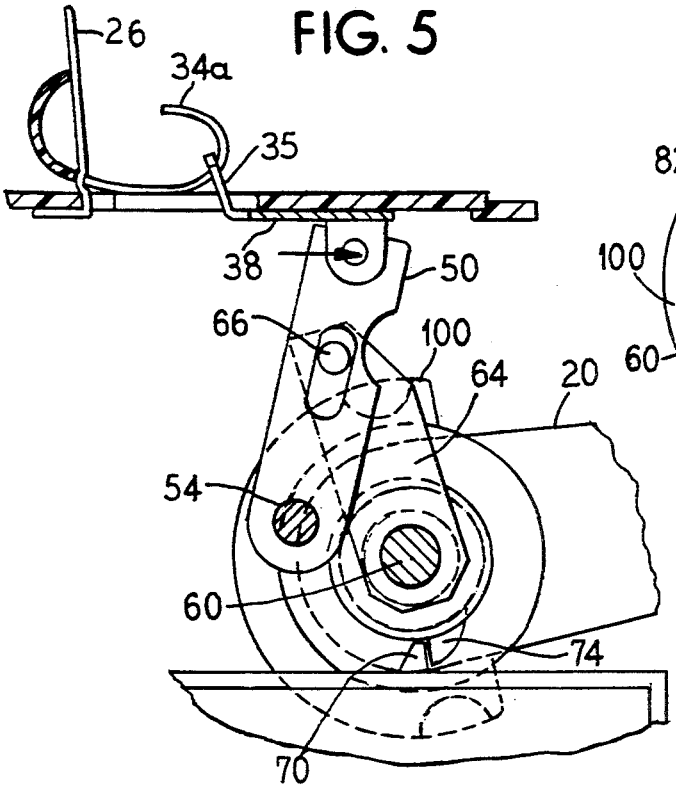
FIG. 5 is a sectional view taken generally along line V—V of FIG. 4.

FIGS. 2 and 5 illustrate the ring opening mechanism in more detail. A ring binding element 34 is shown arranged enmesh with the tines 26 of the comb structure 24. A plurality of finger members 35 such as hooks, proceed from a bottom side of the cover 11 through the slots 30 and engage with each corresponding ring 34*a* of the ring binding element 34. Such engagement is described, for example, in U.S. Pat. Nos. 3,125,887 and 3,227,023, herein incorporated by reference. A sliding movement of the fingers 35 along the slots 30 opens the ring binding elements 34*a* at a top end thereof for eventually threading on of a stack of pages with the ring binding elements 34*a* inserting into a corresponding punched hole of the stack of pages.

Figure 4:
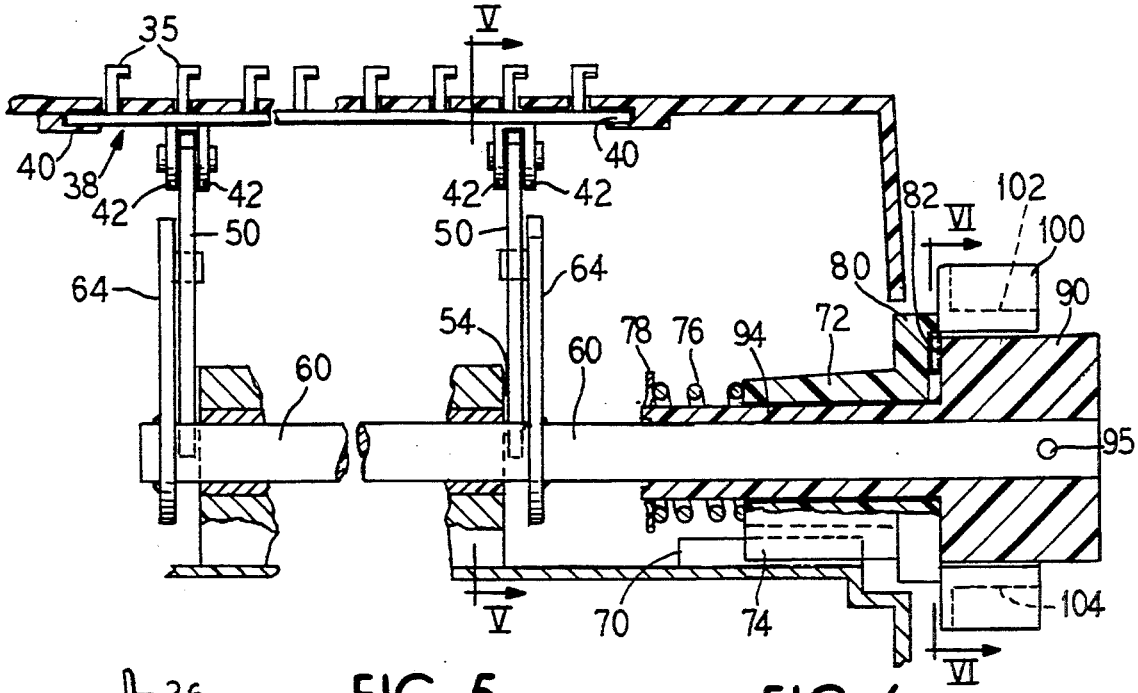
FIG. 4 is a longitudinal sectional view of the ring opening mechanism of the present invention.

The finger members 35 are mounted to a chassis 38 arranged below the cover 11. The chassis 38 is guided for sliding movement with respect to the cover 11 such as by channels 40 as shown in FIG. 4. The chassis 38 provides pairs of downwardly extending lugs 42 having coaxial apertures for holding a pin 44 therethrough. The pin 44 attaches the lugs 42 to a linkage 50 in pivotable fashion. A plurality of such linkages 50 are connected in parallel along a linkage rock shaft 54 which is journaled with respect to the cover for axial rotation. At a central portion of the linkage 50 is arranged an elongate slot 56.

A lever rock shaft 60 is provided which is connected to the lever 20 for axial rotation upon pivoting of the handle 22. The lever rock shaft 60 is guided within the apparatus 10 with respect to the cover 11 for axial rotary movement only. Fixedly connected to the lever rock shaft 60 is an actuating lever 64 having a pin 66 fixed thereto and registered into the elongate slot 56 of the linkage 50. Therefore, a pivoting of the lever 20 causes an axial rotation of the lever rock shaft 60, which causes a swinging movement of the actuating lever 64, which causes an orbiting of the pin 66 which causes the linkage 50 to pivot about the linkage rock shaft 54 which, in turn, causes a sliding of the chassis 38. A stop gusset 70 is provided fixed with respect to the cover 11. A stop ring 72 is mounted coaxially with respect to said lever rock shaft 60. The stop ring 72 provides a protuberance 74 extending radially therefrom which is sized to interfere with the stop 70 upon sufficient rotation of the stop ring 72. The stop ring 72 is biased by a spring 76 from a retainer 78 both arranged coaxially with respect to the lever rock shaft 60 as described below.

Figure 3:
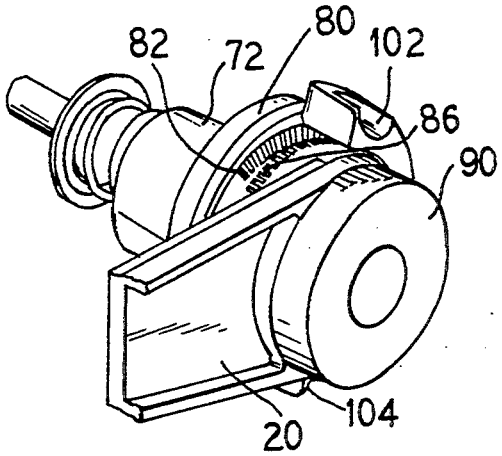
FIG. 3 is a perspective view of a portion of the mechanism of FIG. 2.
Figure 6:
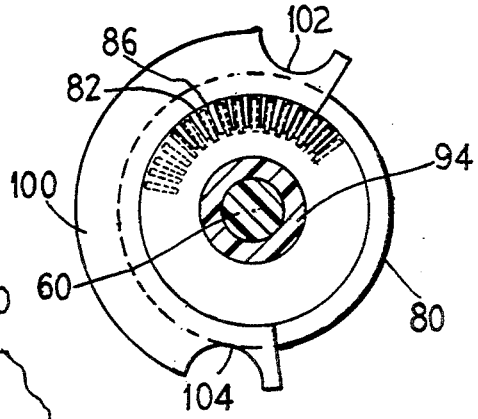
FIG. 6 is a sectional view taken generally along line VI—VI of FIG. 4.

FIGS. 3 and 6 show the stop ring 72 having an outwardly extending annular flange 80 providing gear teeth 82 extending axially outwardly for meshing with a series of second gear teeth 86 arranged on a knob portion 90. The knob portion 90 is fixed to the lever 20 and rotates therewith.

As illustrated in FIG. 4, the knob portion 90 provides a reduced diameter barrel section 94 which extends inwardly and surrounds the lever rock shaft 60 closely and is affixed thereto either by a screw 95 or by a key, or a press fit, or some other such arrangement wherein the knob portion 90, the barrel section 94 and the lever rock shaft 60 must axially rotate together. The spring 76 abuts an inward end of the stop ring 72 and abuts the retainer 78 which is fixed to the barrel section 94. Therefore, the stop ring 72 is biased outwardly toward the knob portion 90 and therefore the first gear teeth 82 and the second gear teeth 86 are meshed together. To demesh the gear teeth 82, 86 the user grasps a selection ring 100, which is fixed to the flange 80, at allocated finger gripping regions 102, 104, depresses the turning ring 100 inwardly against the force of the spring 76 to disengage the gear teeth 82, 86, wherein now the stop ring 72 can be axially rotated to adjust the rotary position of the stop member 74 with respect to the rotary position of the second rock shaft 60. Releasing the selection ring re-meshes the gear teeth.

FIG. 4 illustrates that a plurality of actuating levers 64 are arranged along the shaft 60 which engage to a plurality of binder linkages 50 which engage to a plurality of lugs 42 arranged along a length of the chassis 40 for operating a plurality of finger members 35 simultaneously.

Figure 7:
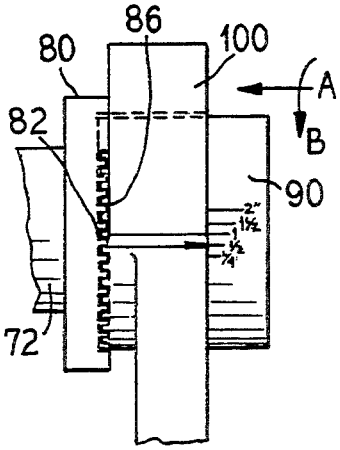
FIG. 7 is a elevational view of a portion of the apparatus of FIG. 1.

FIG. 7 illustrates the selection ring 100 and the knob portion 90 wherein the selection ring 100 can be depressed in the direction A and then turned in the rotary direction B to adjust the stop according to the markings applied onto the knob portion 90, such as 2 inch, 1½ inch, 1 inch, ½ inch, ¼ inch, which correspond to the thickness of the stack of pages to be bound by the binding element.

Although the present invention has been described with reference to a specific embodiment, those of skill in the art will recognize that changes may be made thereto without departing from the scope and spirit of the invention as set forth in the appended claims.

I claim as my invention:

1. An apparatus for opening rings of a flexible multi-ring binding element having a spine portion and ring elements for holding pages thereon, comprising:

a housing; means for holding a spine portion of a multi-ring binding element;

a plurality of finger members corresponding to a plurality of ring elements and engageable to the ring elements;

a chassis connecting the finger members;

a lever rock shaft guided for axial rotation;

a lever, pivotable by an operator, and connected to said lever rock shaft for causing axial rotation of said rock shaft upon pivoting of said lever;

means for converting an axial rotation of said lever rock shaft to a sliding motion of said chassis to cause said finger members to uncurl said ring elements;

a stop member allocated onto said housing;

a stop ring mounted for rotation with said lever rock shaft and having a protrusion for interference with said stop member upon preselected rotary movement; and wherein said stop ring is adjustable in rotary position around said lever rock shaft to set an initial rotary position of said protrusion.

2. The apparatus according to claim 1, wherein said stop ring comprises first engaging means, and said lever rock shaft comprises second engaging means, said first and second engaging means for selectively locking said stop ring and lever rock shaft at selected relative rotary positions with respect thereto, and said apparatus further comprising a spring means for biasing said first engaging means into engagement with said second engaging means.

3. The apparatus according to claim 1, wherein said means for converting comprises an actuation lever connected at a base end to said lever rock shaft to swing upon rotation of said lever rock shaft; and a linkage pivotally connected to said chassis at one end and pivotally connected to the housing at an opposite end thereto, said actuation lever pivotally connected at a distal end thereof to said linkage at a central portion thereof.

4. An apparatus for opening rings of a flexible multi-ring binding element having a spine portion and ring elements for holding pages thereon, comprising:

a housing;

means for holding a spine portion of a multi-ring binding element;

a plurality of finger members corresponding to a plurality of ring elements and engageable to the ring elements;

a chassis connecting the finger members;

a lever rock shaft guided for axial rotation;

a lever, pivotable by an operator, and connected to said lever rock shaft for causing axial rotation of said rock shaft upon pivoting of said lever;

means for converting an axial rotation of said lever rock shaft to a sliding motion of said chassis to cause said finger members to uncurl said ring elements;

a stop member allocated onto said housing;

a stop ring mounted for rotation with said lever rock shaft and having a protrusion for interference with said stop member upon preselected rotary movement; and wherein said stop ring comprises an annular flange having stop ring gear teeth and said lever comprises a knob portion having corresponding gear teeth facing said stop ring gear teeth of said flange; and a retaining means fixed axially with respect to said lever rock shaft and a spring arranged between said retaining means and said stop ring to bias said stop ring gear teeth into meshing engagement with said corresponding gear teeth.

5. The apparatus according to claim 4, wherein said knob portion comprises incremented markings corresponding to a desired opening width of said binder element; and said stop ring comprises a turning ring accessible to an operator for depressing said stop ring gear teeth away from said corresponding gear teeth to disengage, and having an edge for select alignment with a selected one of said incremented markings.

6. The apparatus according to claim 4, wherein said lever comprises a barrel portion connected to said knob portion and surrounding said lever rock shaft and fixed thereto; and said retaining means comprises a ring fixed for axial movement to said barrel portion.

7. The apparatus according to claim 6, wherein said knob portion comprises incremented markings corresponding to a desired opening width of said binder element; and said stop ring comprises a turning ring accessible to an operator for depressing said stop ring gear teeth away from said corresponding gear teeth to disengage, and having an edge for select alignment with a selected one of said incremented markings.

8. The apparatus according to claim 7, wherein said means for converting comprises an actuation lever connected at a base end to said lever rock shaft to swing upon rotation of said lever rock shaft; and a linkage pivotally connected to said chassis at one end and pivotally connected to the housing at an opposite end thereto, said actuation lever pivotally connected at a distal end thereof to said linkage at a central portion thereof.

9. For use in an apparatus for opening rings of a flexible multi-ring binder element, wherein a rock shaft is connected to a chassis carrying a plurality of finger members for engaging the rings of the binder element and slides said chassis a prescribed distance to uncurl the rings upon a preselected rotary movement of said rock shaft, and wherein a lever is connected to said rock shaft for rotating said rock shaft, an adjustable binder stop comprising:

a fixed stop member, and a stop ring rotatably adjustably engageable about said rock shaft and having a protrusion for interference with said stop member upon preselected rotary movement of said rock shaft.

10. The adjustable binder stop of claim 9, wherein said stop ring comprises an annular flange having stop ring gear teeth and said lever comprises a knob portion having corresponding gear teeth facing said stop ring gear teeth of said flange; and a retaining means fixed axially with respect to said lever rock shaft and a spring arranged between said retaining means and said stop ring to bias said stop ring gear teeth into meshing engagement with said corresponding gear teeth.

* * * * *

UNITED STATES PATENT AND TRADEMARK OFFICE

CERTIFICATE OF CORRECTION

PATENT NO. : 5,419,668

DATED : May 30, 1995

INVENTOR(S) : Thomas Battisti

It is certified that error appears in the above-indentified patent and that said Letters Patent is hereby corrected as shown below:

On the title page, under item [19] and item [75], change "Ballist" to --Battisti--.

Signed and Sealed this

Twenty-first Day of November, 1995

Bruce Lehman

*Attest:*

BRUCE LEHMAN

*Attesting Officer*

*Commissioner of Patents and Trademarks*